US011122958B2

(12) United States Patent
Liarte Marin et al.

(10) Patent No.: US 11,122,958 B2
(45) Date of Patent: Sep. 21, 2021

(54) DOMESTIC DISHWASHER HAVING A METERING DEVICE

(71) Applicant: BSH Hausgeräte GmbH, Munich (DE)

(72) Inventors: Juan Alberto Liarte Marin, Saragossa (ES); Ander Villate Robles, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 112 days.

(21) Appl. No.: 16/603,869

(22) PCT Filed: May 7, 2018

(86) PCT No.: PCT/EP2018/061656

§ 371 (c)(1),
(2) Date: Oct. 9, 2019

(87) PCT Pub. No.: WO2018/215192

PCT Pub. Date: Nov. 29, 2018

(65) Prior Publication Data

US 2020/0113410 A1 Apr. 16, 2020

(30) Foreign Application Priority Data

May 23, 2017 (DE) ..... 10 2017 208 702.1

(51) Int. Cl.
*A47L 15/44* (2006.01)

(52) U.S. Cl.
CPC ..... *A47L 15/4463* (2013.01)

(58) Field of Classification Search
CPC ..... A47L 15/4463; A47L 15/4472; A47L 15/449; B65D 83/04; B65D 83/0409; B65D 2583/04; B65D 2583/0459; B65D 2583/0472; B65D 2583/0477; B65D 2583/049; B65D 2583/0495
See application file for complete search history.

(56) References Cited

U.S. PATENT DOCUMENTS 4,887,816 A * 12/1989 Hanna ..... A63F 7/048 273/144 A
7,896,195 B2 3/2011 Limback et al.
(Continued)

FOREIGN PATENT DOCUMENTS

DE 10058460 A1 5/2002
EP 1159913 A1 12/2001
(Continued)

OTHER PUBLICATIONS

Machine Translation of Preugschas, EP 1159913 A1, Dec. 2001. (Year: 2001).*
(Continued)

*Primary Examiner* — David G Cormier
(74) *Attorney, Agent, or Firm* — Michael E. Tschupp; Brandon G. Braun; Andre Pallapies

(57) ABSTRACT

A dosing apparatus for dispensing molded cleaning agent bodies into a dishwashing chamber of a household dishwasher includes a reservoir for holding a supply of molded cleaning agent bodies, a cell wheel configured to actively transport the molded cleaning agent bodies from the reservoir into the dishwashing chamber, and a feed facility configured to feed the molded cleaning agent bodies to the cell wheel in parallel relation to an axis of rotation of the cell wheel.

16 Claims, 5 Drawing Sheets

(56) References Cited

U.S. PATENT DOCUMENTS

| | | | | |
|---|---|---|---|---|
| 2005/0045652 | A1 | 3/2005 | Maser | |
| 2020/0221924 | A1 * | 7/2020 | Fletcher | A47L 15/449 |

FOREIGN PATENT DOCUMENTS

| | | | |
|---|---|---|---|
| WO | 02058528 | A1 | 8/2002 |
| WO | 03023120 | A1 | 3/2003 |

OTHER PUBLICATIONS

National Search Report DE 10 2017 208 702.1 dated May 8, 2018.
International Search Report PCT/EP2018/061656 dated Jul. 16, 2018.

* cited by examiner

DOMESTIC DISHWASHER HAVING A METERING DEVICE

CROSS-REFERENCES TO RELATED APPLICATIONS

This application is the U.S. National Stage of International Application No. PCT/EP2018/061656, filed May 7, 2018, which designated the United States and has been published as International Publication No. WO 2018/215192 A1 and which claims the priority of German Patent Application, Serial No. 10 2017 208 702.1, filed May 23, 2017, pursuant to 35 U.S.C. 119(a)-(d).

BACKGROUND OF THE INVENTION

The present invention relates to a dosing apparatus for dispensing molded cleaning agent bodies into a dishwashing container of a household dishwasher and a household dishwasher with such a dosing apparatus.

With commercially available household dishwashers it is necessary to feed in cleaning agents in powder or tablet form manually before the start of a dishwashing operation. Only with rinse aid is it usual to store it in liquid form in a reservoir inside the household dishwasher for a number of applications and dispense it automatically by way of a dosing apparatus. Many users find it a nuisance and inconvenient to dispense cleaning agents manually before every dishwashing operation. Attempts have therefore been made over quite a long period to develop what are known as automatic dosing systems for household dishwashers, with the aim of allowing cleaning agents to be stored in reservoirs for a number of applications and to be dispensed automatically by way of corresponding dosing apparatuses.

EP 1 159 913 A1 for example shows a dosing facility for dispending cleaning tablets from a reservoir intro the useful space of a dishwasher, in which an essentially steam-proof lock is arranged between reservoir and useful space. The reservoir here is configured to hold a loose supply of tablets and the lock has a transport facility, for example in the form of a cell wheel, to actively transport the tablets through. Tablets can only be fed from the transport container to the transport facility by gravity. However a conveying facility is preferably provided, which conveys the tablets actively (subject to external force) from the reservoir to the transport facility.

BRIEF SUMMARY OF THE INVENTION

Against this background one object of the present invention is to provide an improved dosing apparatus.

A dosing apparatus for dispensing molded cleaning agent bodies into a dishwashing chamber of a household dishwasher is therefore proposed. The dosing apparatus comprises a reservoir for holding a supply of the molded cleaning agent bodies, a cell wheel for actively transporting the molded cleaning agent bodies from the reservoir into the dishwashing chamber and a feed facility for feeding the molded cleaning agent bodies to the cell wheel, the feed facility being designed to feed the molded cleaning agent bodies to the cell wheel parallel to an axis of rotation of the same.

Because the feed facility is provided, it is always also ensured that the molded cleaning agent bodies are fed to the cell wheel even if the fill level of the reservoir is low. There is also no need for a sloping surface in the reservoir to feed the molded cleaning agent bodies to the cell wheel parallel to the axis of rotation. This increases the volume available in the reservoir for holding the molded cleaning agent bodies.

The term "molded cleaning agent bodies" in the context of the invention refers to all molded bodies with a defined outer shape, which contain any ingredients that can be used for cleaning dishes. They include for example tablets, pellets, granules or capsules. The term is also not limited to molded bodies containing the actual cleaning agent. It also covers molded bodies holding dispensing agents for use in final rinse operations, for softening or conditioning water and the like.

The reservoir is in particular the region of the dosing apparatus that contains the store of molded cleaning agent bodies. It can be refillable or for example replaceable in the form of a cartridge. The reservoir is configured to hold a supply, in particular a loose supply, of molded cleaning agent bodies. This means that the molded cleaning agent bodies lie with random orientation in the reservoir and are not stored in a predefined geometric arrangement. The configuration of the reservoir for holding a supply of molded cleaning agent bodies allows simple and compact storage even of larger quantities of molded cleaning agent bodies. It is not necessary to store the tablets in a complex manner. Active transportation of the molded cleaning agent bodies from a delivery opening of the reservoir into the dishwashing chamber means that a desired quantity of molded cleaning agent bodies is reliably dosed in. Active transportation here means that the molded cleaning agent bodies are transported subject to external force. For example the cell wheel can be actively rotated with the aid of a drive unit, for example with the aid of an electric motor, for this purpose.

According to one embodiment the feed facility comprises a feed wheel that can be rotated about the axis of rotation and a guide element, along which the molded cleaning agent bodies are guided parallel to the axis of rotation during a rotational movement of the feed wheel.

The axis of rotation is preferably a common axis of rotation of the cell wheel and the feed wheel. The feed wheel preferably comprises a cylindrical feed segment and a fastening segment projecting from the feed segment, to which the cell wheel is connected. The guide element is preferably connected to the reservoir in a fixed manner. The feed element is configured for example as a strip-like part, which extends from a side wall of the reservoir in the direction of the feed wheel.

According to a further embodiment the dosing apparatus comprises a hollow space, in which the cell wheel is supported in a rotatable manner, the feed wheel being arranged outside the hollow space.

The dosing apparatus preferably comprises a housing, in which the hollow space is provided. The housing can be arranged within the reservoir. The cell wheel and feed wheel are supported on the housing in a rotatable manner, the cell wheel being arranged within the housing, in other words in the hollow space, and the feed wheel being arranged outside the housing. A side wall of the housing can be arranged between the cell wheel and the feed wheel.

According to a further embodiment the feed wheel is connected to the cell wheel in a rotationally fixed manner.

In other words the feed wheel cannot be rotated relative to the cell wheel.

According to a further embodiment the feed wheel is connected to the cell wheel with a form fit.

A form-fit connection results when at least two connecting parts engage in or behind one another. External ribs are preferably provided on the feed segment of the feed wheel, being designed to engage with a form fit in corresponding recesses or grooves in the cell wheel. The recesses are provided in particular on a drive cylinder of the cell wheel.

According to a further embodiment the feed wheel comprises a plurality of feed ribs.

The feed ribs are preferably arranged on the outside of the cylindrical feed segment pf the feed wheel. There can be any number of feed ribs.

According to a further embodiment the feed ribs are at an angle to the axis of rotation.

For example the feed ribs can be at an angle of 20 to 40°, preferably 25 to 30°, more preferably 30°, to the axis of rotation.

According to a further embodiment the feed ribs are spiral.

In other words the feed ribs can run around the feed segment in a helical or spiral manner.

According to a further embodiment the cell wheel comprises a plurality of separating walls, the number of feed ribs being greater than the number of separating walls.

The number of feed ribs is preferably a plurality of the number of separating walls.

A household dishwasher with such a dosing apparatus is also proposed.

For example the dosing apparatus can be provided on a door, on a side wall of a dishwashing container or on a receptacle for items to be washed in the household dishwasher.

Further possible implementations of the dosing apparatus and/or the household dishwasher include combinations of features or embodiments described above or in the following in relation to the exemplary embodiments even if these are not cited specifically. The person skilled in the art will also add individual aspects to improve or complete the respective basic form of the dosing apparatus and/or household dishwasher.

BRIEF DESCRIPTION OF THE DRAWINGS

Further advantageous configurations and aspects of the dosing apparatus and/or household dishwasher are set out in the subclaims and the exemplary embodiments of the dosing apparatus and/or household dishwasher described in the following. The dosing apparatus and/or household dishwasher is/are described in more detail below based on preferred embodiments with reference to the accompanying figures.

DETAILED DESCRIPTION OF EXEMPLARY EMBODIMENTS OF THE PRESENT INVENTION

Figure 1:
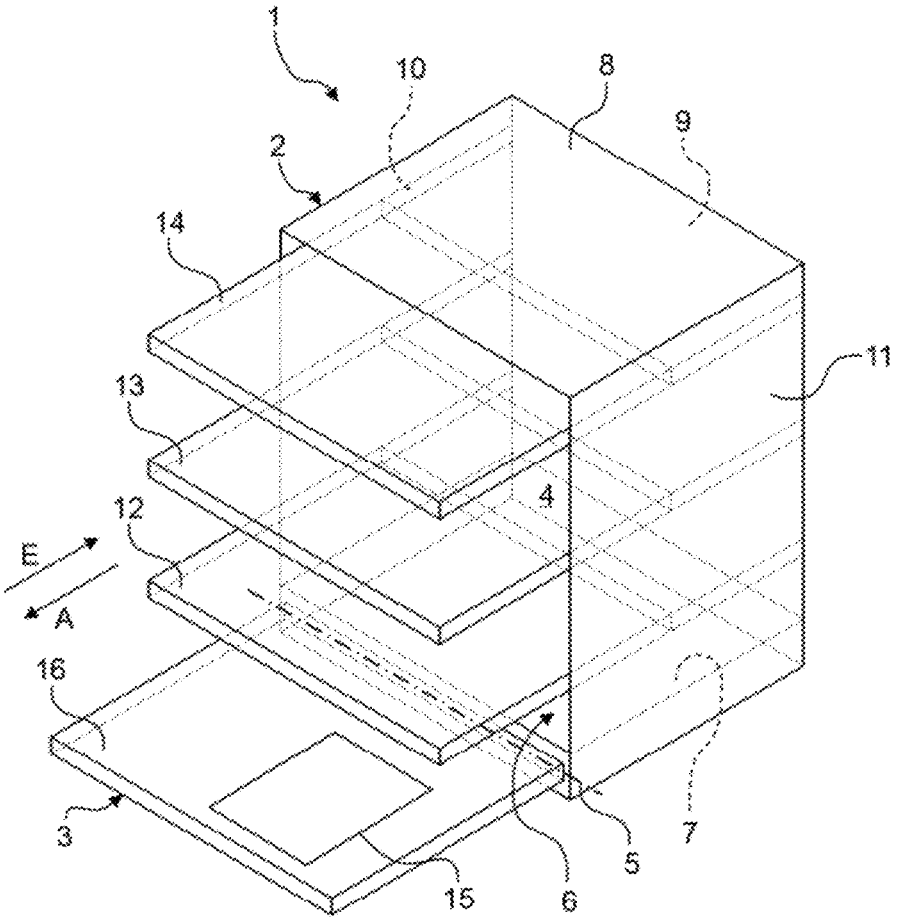
FIG. 1 shows a schematic perspective view of an embodiment of a household dishwasher.

Identical elements or those of identical function are shown with the same reference characters in the figures, unless otherwise specified.

FIG. 1 shows a schematic perspective view of an embodiment of a household dishwasher 1. The household dishwasher 1 comprises a dishwashing container 2, which can be closed by a door 3, in particular in a water-tight manner. To this end a sealing facility can be provided between the door 3 and the dishwashing container 2. The dishwashing container 2 is preferably box-shaped. The dishwashing container 2 can be arranged in a housing of the household dishwasher 1. The dishwashing container 2 and door 3 can form a dishwashing chamber 4 for washing items to be washed.

The door 3 is shown in its opened position in FIG. 1. The door 3 can be closed or opened by pivoting about a pivot axis 5 provided at a lower end of the door 3. The door 3 can be used to close or open a loading opening 6 of the dishwashing container 2. The dishwashing container 2 has a base 7, a top 8 arranged opposite the base 7, a rear wall 9 arranged opposite the closed door 3 and two side walls 10, 11 arranged opposite one another. The base 7, top 8, rear wall 9 and side walls 10, 11 can be made of stainless steel sheet for example. Alternatively the base 7 for example can be made of a plastic material.

The household dishwasher 1 also has at least one holder 12 to 14 for items to be washed. Several, for example three, holders 12 to 14 for items to be washed can preferably be provided, it being possible for the holder 12 for items to be washed to be a lower holder for items to be washed or a lower rack, the holder 13 for items to be washed to be an upper holder for items to be washed or an upper rack and the holder 14 for items to be washed to be a flatware drawer. As also shown in FIG. 1, the holders 12 to 14 for items to be washed are arranged one above the other in the dishwashing container 2. Each holder 12 to 14 for items to be washed can be moved into or out of the dishwashing container 2 as required. In particular each holder 12 to 14 for items to be washed can be pushed into the dishwashing container 2 in an insertion direction E and pulled out of the dishwashing container 2 in a removal direction A counter to the insertion direction E.

The household dishwasher 1 also comprises a dosing apparatus 15, which can be arranged on the inside of the door 3, in other words facing the dishwashing chamber 4. In particular the dosing apparatus 15 is provided on an inner face 16 of the door 3. Alternatively the dosing apparatus 15 can be provided on one of the side walls 10, 11 or on one of the holders 12 to 14 for items to be washed. In the example in FIG. 1 the dosing apparatus 15 is arranged on the door 3, so that it is oriented toward the dishwashing chamber 4 when the door 3 is closed. This advantageously allows the dosing apparatus 15 to dispense molded cleaning agent bodies into the dishwashing chamber 4. The molded cleaning agent bodies are then dissolved by the washing liquor present in the dishwashing chamber 4.

Figure 2:
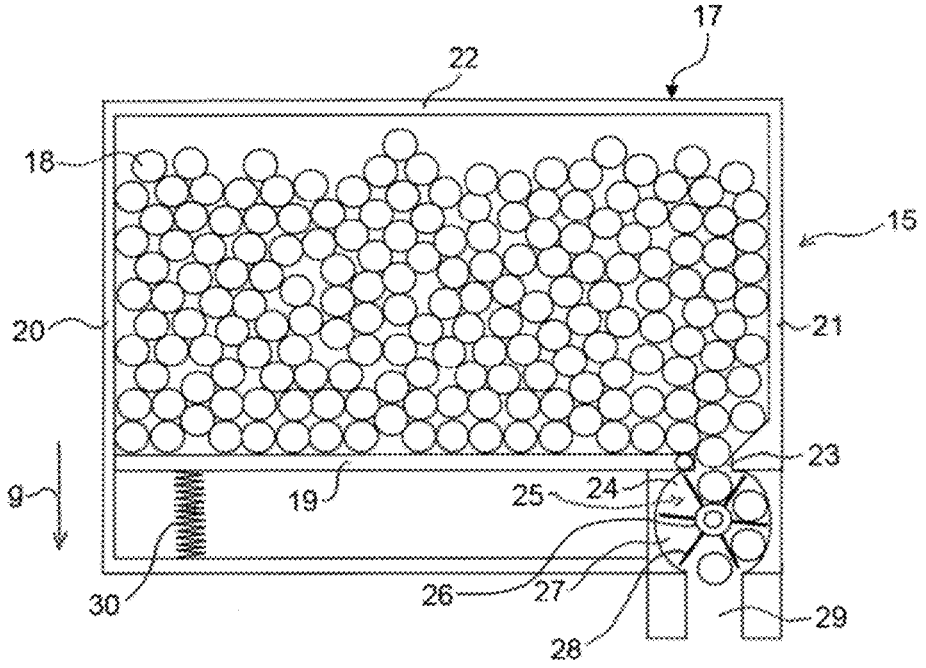
FIG. 2 shows a schematic side view of an embodiment of a dosing apparatus for the household dishwasher according to FIG. 1.

FIG. 2 shows a cross-sectional view of an embodiment of the dosing apparatus 15. Molded cleaning agent bodies 18 are present in a reservoir 17. The reservoir 17 has a base 19, side walls 20, 21 and a lid 22. As shown, the reservoir 17 can be configured as part of a cartridge, which can be replaced in its entirety when the supply of molded cleaning agent bodies has been used. Alternatively the lid 22 can also be designed so that it can be removed or pivoted to allow the reservoir 17 to be refilled.

In FIG. 2 the reservoir 17 is shown in a state in which there are still so many molded cleaning agent bodies 18 in the reservoir 17 that the base 19 is in an initial position, such as it is in when completely filled. In the illustrated exemplary embodiment, in which the reservoir 17 is embodied as a box-shaped container and the dosing apparatus 15 is shown in the operating position, the base 19 is therefore almost horizontal. The direction of gravity when the dosing apparatus 15 is in the operating position is shown with an arrow g in FIG. 2.

A delivery opening 23 is provided in the region of the base 19 of the reservoir 17. A hollow space 24 adjoins the delivery opening 23 in the direction of gravity g, a cell wheel 25 being held and supported in a rotatable manner therein. The cell wheel 25 has a drive cylinder 16, which is actively driven by a drive unit (not shown), for example in the form of an electric motor. The cell wheel 25 comprises a number of transport chambers 27, which are each configured to hold a predefined quantity of molded cleaning agent bodies 18. The transport chambers 27 are separated from one another by separating walls 28 projecting radially from the drive cylinder 26. Any number of separating walls 28 can be provided. The separating walls 28 are fastened to the drive cylinder 26, preferably being configured as a single piece with it. Both the reservoir 17 with its delivery opening 23 and an ejector chute 29 open at the periphery of the cell wheel 25.

During operation of the dosing apparatus 15 molded cleaning agent bodies 18 present in the reservoir 17 are first moved in the direction of the delivery opening 23 by gravity and thus fed to the cell wheel 25. During the rotational movement of the cell wheel 25 a quantity of molded cleaning agent bodies 18 limited by the capacity of the transport chambers 27 drops out of the reservoir 17 through the delivery opening 23 into an empty transport chamber 27. The molded cleaning agent bodies 18 are then ejected through the ejector chute 29 present diametrically on the opposite side of the periphery of the hollow space 24, where they drop into the dishwashing chamber 4 of the household dishwasher 1.

Figure 3:
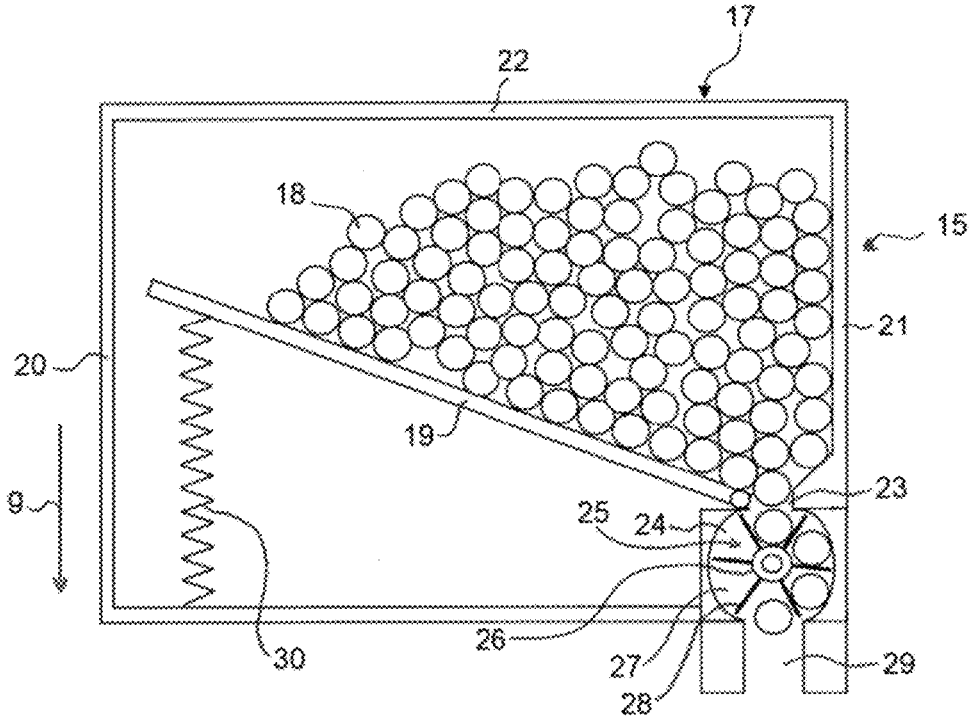
FIG. 3 shows a further schematic side view of the dosing apparatus according to FIG. 2.

FIG. 3 shows the dosing apparatus 15 in a state in which the reservoir 17 is only partially filled with molded cleaning agent bodies 18. The repeated dispensing of molded cleaning agent bodies 18 into the dishwashing chamber 4 means that the quantity of molded cleaning agent bodies 18 in the reservoir 17 and therefore their weight decreases. This decrease in weight means that a lifting facility 30, designed as a spring in the form of a helical spring in the illustrated exemplary embodiment, automatically raises part of the base 19 of the reservoir 17, such raising of the base 19 resulting in a sloping discharge surface in the direction of the delivery opening 23. This sloping discharge surface ensures that the molded cleaning agent bodies 18 are reliably fed to the delivery opening 23 by gravity even when the reservoir 17 is less full. Specifically in this exemplary embodiment the sloping discharge surface results from the base 19 being supported in a rotatable manner adjacent to the delivery opening 23 and the lifting facility 30 engaging with the base 19 at a distance from it. Alternatively the base 19 can also be supported on the drive cylinder 26 in a rotatable manner.

Figure 4:
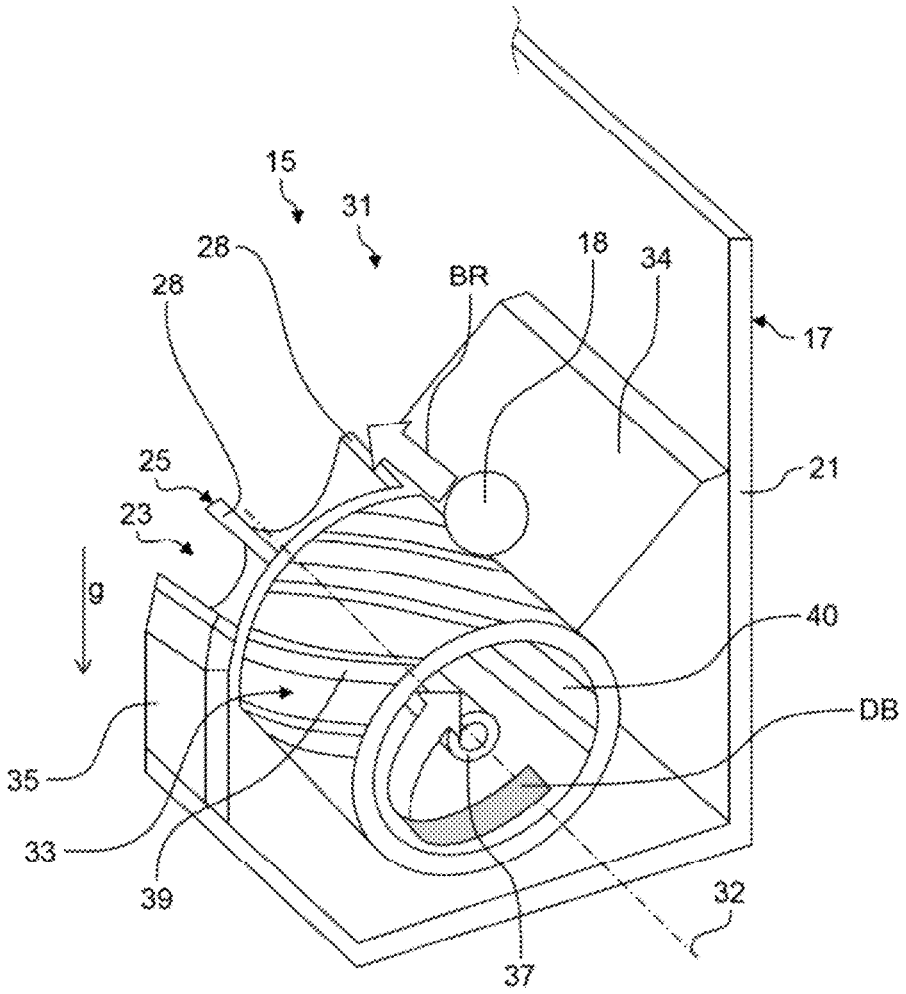
FIG. 4 shows a schematic perspective detailed view of the dosing apparatus according to FIG. 2.

FIG. 4 shows a schematic perspective detailed view of the dosing apparatus 15. In addition to the reservoir 17 and the cell wheel 25 the dosing apparatus 15 comprises a feed facility or a feed conveyor 31 for feeding the molded cleaning agent bodies 18 to the cell wheel 25. The feed facility 31 here is designed to feed the molded cleaning agent bodies 18 to the cell wheel 25 parallel to an axis of rotation 32 of the same. The feed facility 31 preferably comprises a feed wheel 33, which can also be rotated about the axis of rotation 32, and a guide element 34, along which the molded cleaning agent bodies 18 are guided parallel to the axis of rotation 32 during a rotational movement DB of the feed wheel 33. A movement direction BR of the molded cleaning agent bodies 18 is shown with the aid of an arrow in FIG. 4.

The guide element 34 is configured for example as a guide plate fastened to the side wall 21 of the reservoir 17. The hollow space 24, in which the cell wheel 25 is held, is enclosed by a housing 35, at the top of which the delivery opening 23 is provided. As also shown in FIG. 4, the cell wheel 25 is arranged within the hollow space 24 but the feed wheel 33 is arranged outside the hollow space 24.

Figure 5:
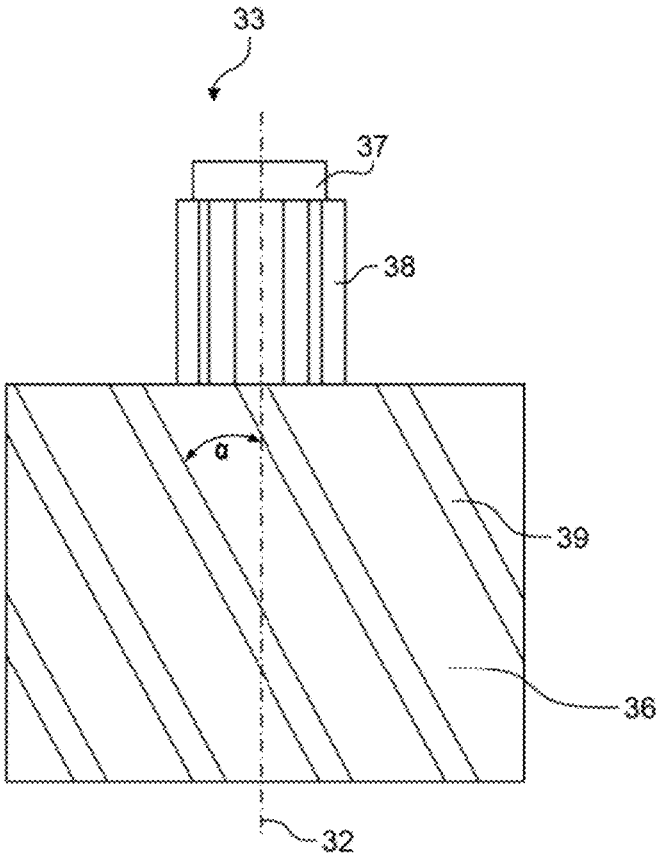
FIG. 5 shows a schematic view from above of an embodiment of a feed wheel for the dosing apparatus according to FIG. 2.

The feed wheel 33 is preferably cylindrical and, as shown in FIG. 5, comprises a feed segment 26 and a fastening segment 37 extending out of the top of the feed segment 36. The cell wheel 25 is fastened to the fastening segment 37 in a rotationally fixed manner. In particular the feed wheel 33 is connected to the cell wheel 25 with a form fit. To this end a plurality of ribs 38 can be provided on the fastening segment 37, engaging with a form fit in corresponding grooves in the cell wheel 25.

The feed wheel 33 also comprises a plurality of feed ribs 39 provided on the feed segment 36, which are at an angle to the axis of rotation 32. For example the feed ribs 39 are at an angle $\alpha$ to the axis of rotation 32. The angle $\alpha$ is for example 20 to 40°, preferably 25 to 35°, more preferably 30°. The feed ribs 39 can also run in a spiral or helical manner around the feed segment 36. Inside the feed segment 26 is a hollow space 40, in which a coupling facility of the movable base 19 can be held. The fastening segment 37 extends into the hollow space 40. The number of feed ribs 39 is preferably greater than the number of separating walls 28 of the cell wheel 25.

The functionality of the dosing apparatus 15 is described below. During the rotational movement DB of the feed wheel 33 and cell wheel 25 about the axis of rotation 32 at least one molded cleaning agent body 18 is guided between two feed ribs 39, provision of the guide element 34 meaning that the molded cleaning agent body 18 is guided onto the cell wheel 25 parallel to the axis of rotation 32 in the movement direction BR.

Provision of the feed facility 31 means that, even if the fill level of molded cleaning agent bodies 18 in the reservoir 17 is low, it is always ensured that the molded cleaning agent bodies 18 are fed to the cell wheel 25. Provision of the feed wheel 33 also allows the cell wheel 25 to be configured in such a manner that it does not take up the full width of the reservoir 17. This means that there is no need to provide a sloping surface angled onto the cell wheel 25 in particular in the widthwise direction of the reservoir 17. This enlarges the volume of the reservoir 17 available for holding the molded cleaning agent bodies 18.

Although the present invention has been described based on exemplary embodiments, it can be modified in many different ways.

The invention claimed is:

1. A dosing apparatus in combination with a household dishwasher and for dispensing molded cleaning agent bodies at least in part by gravity into a dishwashing chamber of the household dishwasher, said dosing apparatus comprising:

a reservoir for holding a supply of molded cleaning agent bodies;

a cell wheel configured to actively transport the molded cleaning agent bodies from the reservoir into the dishwashing chamber; and a feed conveyor configured to feed the molded cleaning agent bodies to the cell wheel in parallel relation to an axis of rotation of the cell wheel, wherein the feed conveyor comprises a feed wheel fastened to the cell wheel for rotation together with the cell wheel along the axis of rotation of the cell wheel, and wherein the axis of rotation of the cell wheel is arranged in parallel to a bottom wall of the reservoir.

2. The dosing apparatus in combination with the household dishwasher of claim 1, wherein the feed conveyor comprises a guide plate configured to guide the molded cleaning agent bodies in parallel relation to the axis of rotation of the cell wheel during a rotational movement of the feed wheel.

3. The dosing apparatus in combination with the household dishwasher of claim 2, further comprising a hollow space, in which the cell wheel is supported in a rotatable manner, said feed wheel being arranged outside the hollow space.

4. The dosing apparatus in combination with the household dishwasher of claim 1, wherein the feed wheel is connected to the cell wheel with a form fit.

5. The dosing apparatus in combination with the household dishwasher of claim 1, wherein the feed wheel comprises a plurality of feed ribs.

6. The dosing apparatus in combination with the household dishwasher of claim 5, wherein the feed ribs extend at an angle to the axis of rotation.

7. The dosing apparatus in combination with the household dishwasher of claim 5, wherein the feed ribs are spiral.

8. The dosing apparatus in combination with the household dishwasher of claim 5, wherein the cell wheel comprises a plurality of separating walls, said feed ribs being provided at a number which is greater than a number of separating walls.

9. A household dishwasher, comprising:

a dishwashing chamber; and a dosing apparatus for dispensing molded cleaning agent bodies into the dishwashing chamber, said dosing apparatus comprising a reservoir for holding a supply of molded cleaning agent bodies, a cell wheel configured to actively transport the molded cleaning agent bodies from the reservoir into the dishwashing chamber, and a feed conveyor configured to feed the molded cleaning agent bodies to the cell wheel in parallel relation to an axis of rotation of the cell wheel, wherein the feed conveyor comprises a feed wheel fastened to the cell wheel for rotation together with the cell wheel along the axis of rotation of the cell wheel, and wherein the axis of rotation of the cell wheel is arranged in parallel to a bottom wall of the reservoir.

10. The household dishwasher of claim 9, wherein the feed conveyor comprises a guide plate configured to guide the molded cleaning agent bodies in parallel relation to the axis of rotation of the cell wheel during a rotational movement of the feed wheel.

11. The household dishwasher of claim 10, further comprising a hollow space, in which the cell wheel is supported in a rotatable manner, said feed wheel being arranged outside the hollow space.

12. The household dishwasher of claim 9, wherein the feed wheel is connected to the cell wheel with a form fit.

13. The household dishwasher of claim 9, wherein the feed wheel comprises a plurality of feed ribs.

14. The household dishwasher of claim 13, wherein the feed ribs extend at an angle to the axis of rotation.

15. The household dishwasher of claim 13, wherein the feed ribs are spiral.

16. The household dishwasher of claim 13, wherein the cell wheel comprises a plurality of separating walls, said feed ribs being provided at a number which is greater than a number of separating walls.

* * * * *